US008602578B2

(12) United States Patent
Risinger et al.

(10) Patent No.: US 8,602,578 B2
(45) Date of Patent: Dec. 10, 2013

(54) TABLETOP LIGHT FOR MACHINE SEWING

(76) Inventors: Patricia Lynn Risinger, Saint Louis, MO (US); John Freeland Doyle, Saint Louis, MO (US)

( * ) Notice: Subject to any disclaimer, the term of this patent is extended or adjusted under 35 U.S.C. 154(b) by 354 days.

(21) Appl. No.: 12/639,982

(22) Filed: Dec. 16, 2009

(65) Prior Publication Data

US 2010/0149784 A1 Jun. 17, 2010

Related U.S. Application Data

(60) Provisional application No. 61/138,240, filed on Dec. 17, 2008.

(51) Int. Cl.
*F21V 33/00* (2006.01)

(52) U.S. Cl.
USPC ..... 362/89

(58) Field of Classification Search
USPC ..... 362/90, 89
See application file for complete search history.

(56) References Cited

U.S. PATENT DOCUMENTS

| | | | | |
|---|---|---|---|---|
| 3,862,409 | A * | 1/1975 | Joella et al. | 362/90 |
| 4,084,216 | A * | 4/1978 | Shonting | 362/90 |
| 4,887,193 | A * | 12/1989 | Dieckmann | 362/89 |
| 6,527,403 | B2 * | 3/2003 | Manuel | 362/90 |
| 6,832,841 | B2 * | 12/2004 | Kitakata | 362/90 |
| 2003/0184995 | A1 * | 10/2003 | Seibert et al. | 362/90 |
| 2010/0002415 | A1 * | 1/2010 | Munn et al. | 362/90 |

* cited by examiner

*Primary Examiner* — Evan Dzierzynski
(74) *Attorney, Agent, or Firm* — Polster, Lieder, Woodruff & Lucchesi, L.C.

(57) ABSTRACT

A directional lighting apparatus that is configured to be placed adjacent a sewing machine to provide illumination to one or more sewing work areas peripheral to the central sewing work area below the sewing machine arm and head. The result is an enhanced view of the fabric sewing area and a substantial reduction in shadows.

16 Claims, 10 Drawing Sheets

TABLETOP LIGHT FOR MACHINE SEWING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This invention relates to an apparatus that is adapted to provide illumination to the sewing work area for a sewing machine, and more particularly, to an apparatus that is adapted to provide additional or supplemental illumination to portions of the sewing work area for a standalone or tabletop sewing machine that are peripheral to the central sewing work area illuminated by traditional illuminated sewing machines and sewing machine illumination devices.

There are many examples of illuminated sewing machines and sewing machine illumination devices. For example, in U.S. Pat. No. 1,609,147 to White (1926), U.S. Pat. No. 1,846,345 to McCarten (1932), U.S. Pat. No. 1,955,284 to Goosman (1934), U.S. Pat. No. 4,413,310 (1983) to Adams, and U.S. Pat. No. 5,113,324 (1992) to Dusch, each disclose sewing machines configured with illumination sources (typically light bulbs) directed only toward the sewing work area beneath the needle-housing head of the sewing machine and to some extent beneath the sewing machine arm—i.e., the primary or "central" sewing work area. No illumination is provided for either multiple portions of the sewing work area or for any area outside the central sewing work area, i.e., they do not address the need for light in more than one location or additional light for activities such as seam ripping or hand needlework.

In recent years, sewing machine manufacturers have offered many models of sewing machines with directional illumination, including for example: Singer Sewing Machine Company's Quantum XL-6000, Futura CE-250 and Futura CE-350; Janome Sewing Machine Company's Memory Craft 11000; Husqvarna Viking Sewing Machine Company's Designer Topaz, Designer Diamond and Designer SE; Pfaff Sewing Machine Company's Creative Vision; Brother Sewing Machine Company's Quattro 6000D and Duetta; Baby Lock Sewing Machine Company's Ellisimo and Ellegante 2; and Bernina Sewing Machine Company's 8 Series. Unfortunately, the illumination provided by such traditional models is likewise directed only to the central sewing work area beneath the sewing machine arm and head. As in the patents cited above, no illumination is provided for either multiple portions of the sewing work area or for any area outside the central sewing work area. Hence, again, this lighting does not help if seam ripping, additional hand needlework is required or if the individual wants to craft.

Yet, for a number of sewing operations and techniques, including for example seam ripping, large fabric sewing, quilting, embroidering, large craftwork, and hand needlework associated with machine sewing, the central sewing work area is simply not large enough, and additional or support sewing work areas surrounding the central sewing work area are often utilized. Hence, for such operations and techniques, the sewing work area that needs to be viewed and illuminated is not limited to the central sewing work area directly beneath the sewing machine arm and head. Rather, the sewing work area for such operations and techniques includes the area bordering and extending away from the outer boundary of the central sewing work area—i.e., a support or "peripheral" sewing work area. It would therefore be desirable for an apparatus to illuminate at least a portion of the peripheral sewing work area. It would also be desirable for an apparatus to illuminate more than one portion of the entire sewing work area.

BRIEF DESCRIPTION OF SEVERAL VIEWS OF THE DRAWINGS

The illustrative embodiments of the present invention are shown in the following drawings which form a part of the specification.

It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses. Before turning to the figures and the various exemplary embodiments illustrated therein, a detailed overview of various embodiments and aspects is provided for purposes of breadth of scope, context, clarity, and completeness.

As described and disclosed herein are various embodiments of the directional sewing machine lighting apparatus of the present disclosure.

Figure 1:
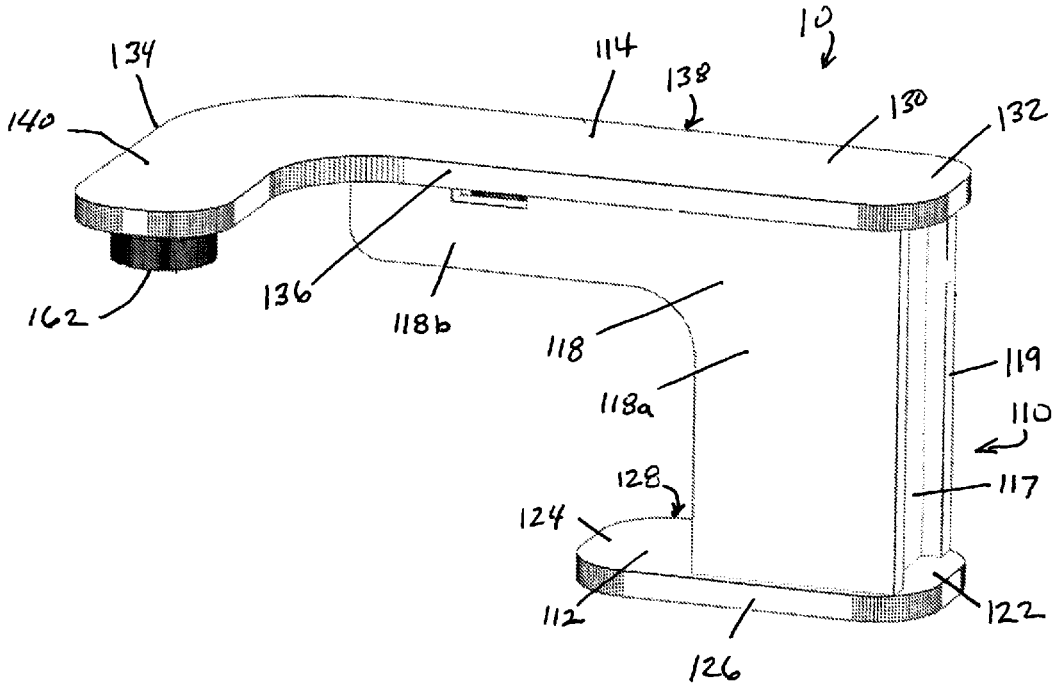
FIG. 1 is a perspective view of a directional lighting apparatus for a sewing machine of the present disclosure according to one representative embodiment.
Figure 2A:
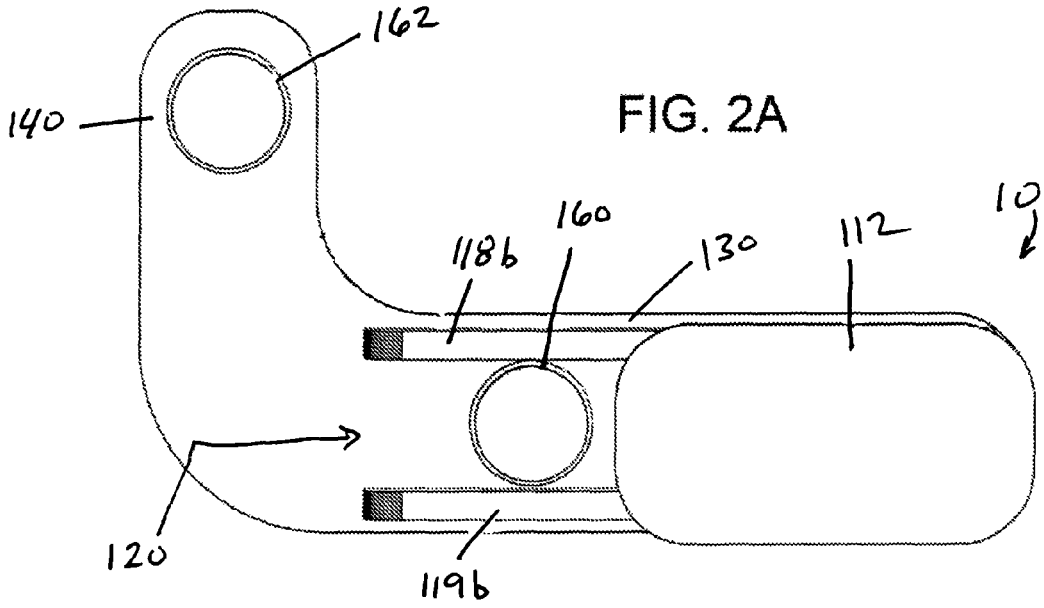
FIG. 2A is a plan view from the underside of the representative embodiment of the directional lighting apparatus for a sewing machine of FIG. 1.
Figure 2B:
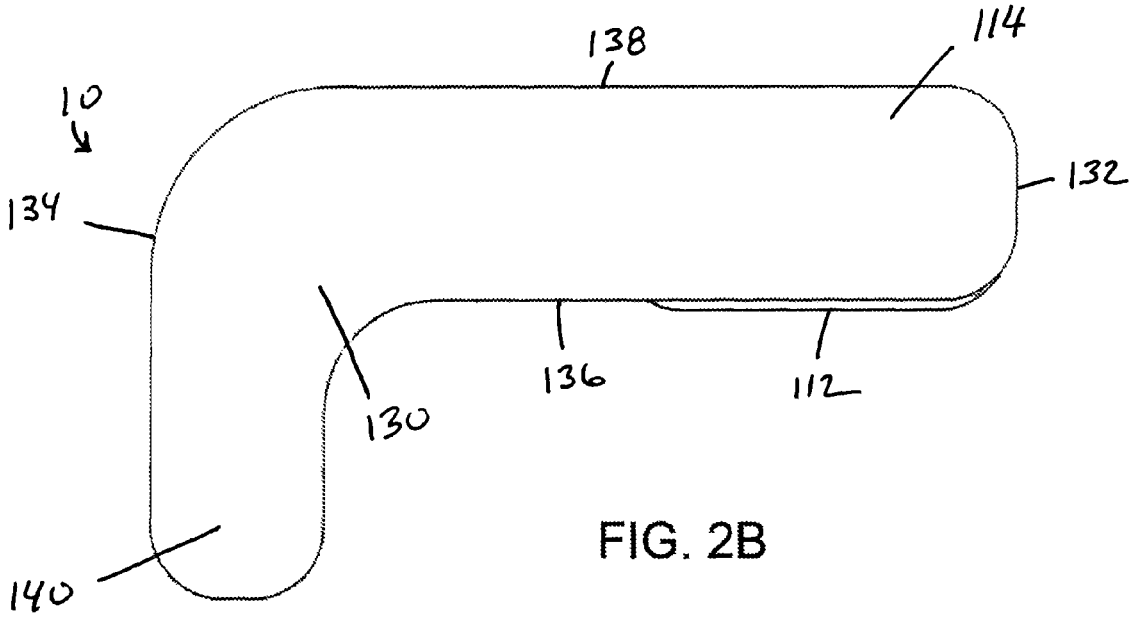
FIG. 2B is a plan view from the top of the representative embodiment of the directional lighting apparatus for a sewing machine of FIG. 1.
Figure 3:
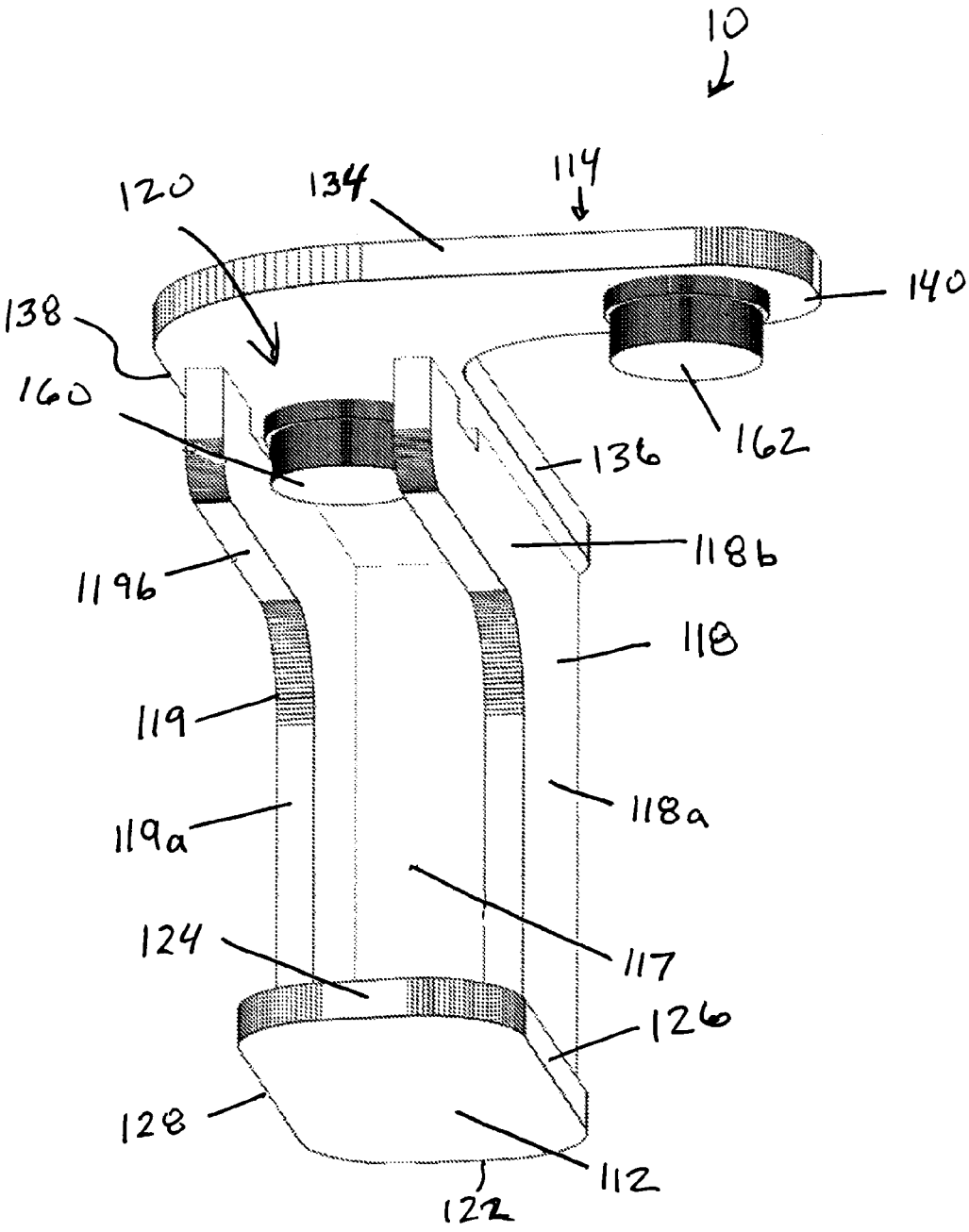
FIG. 3 is a different perspective view of the representative embodiment of the directional lighting apparatus for a sewing machine of FIG. 1.
Figure 4:
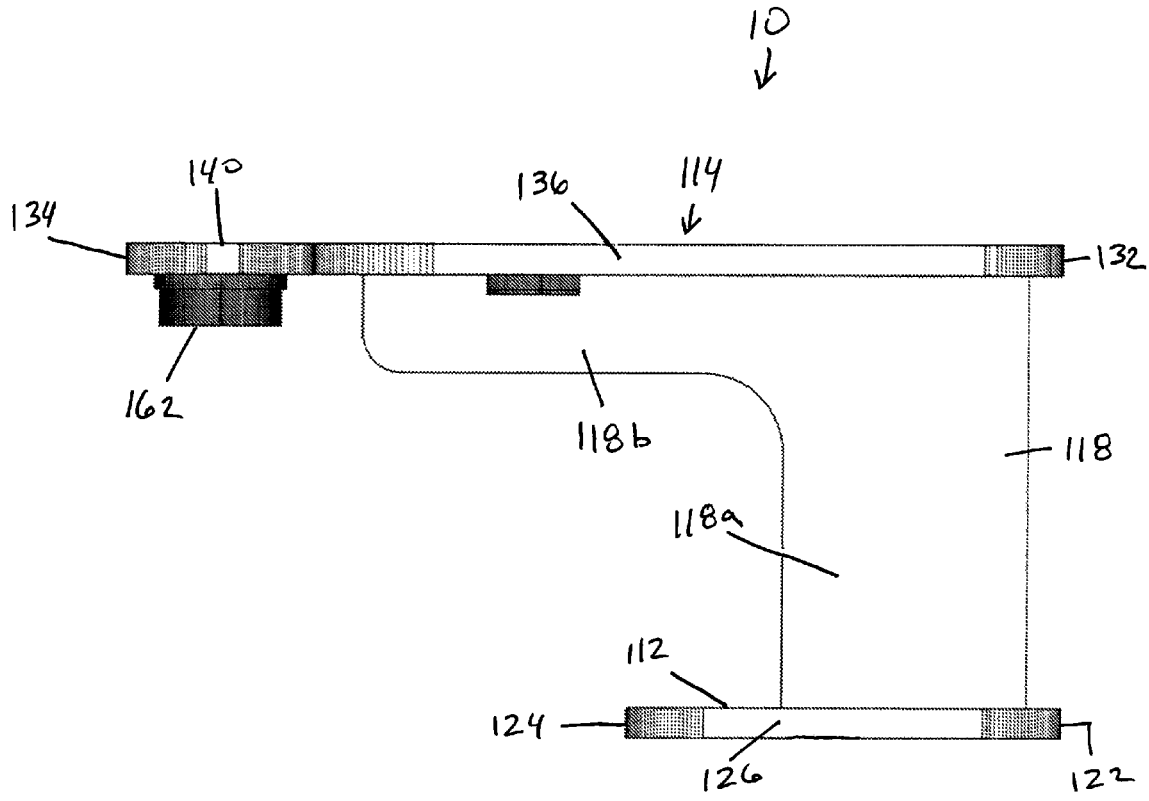
FIG. 4 is a side view of the representative embodiment of the directional lighting apparatus for a sewing machine of FIG. 1.
Figure 5:
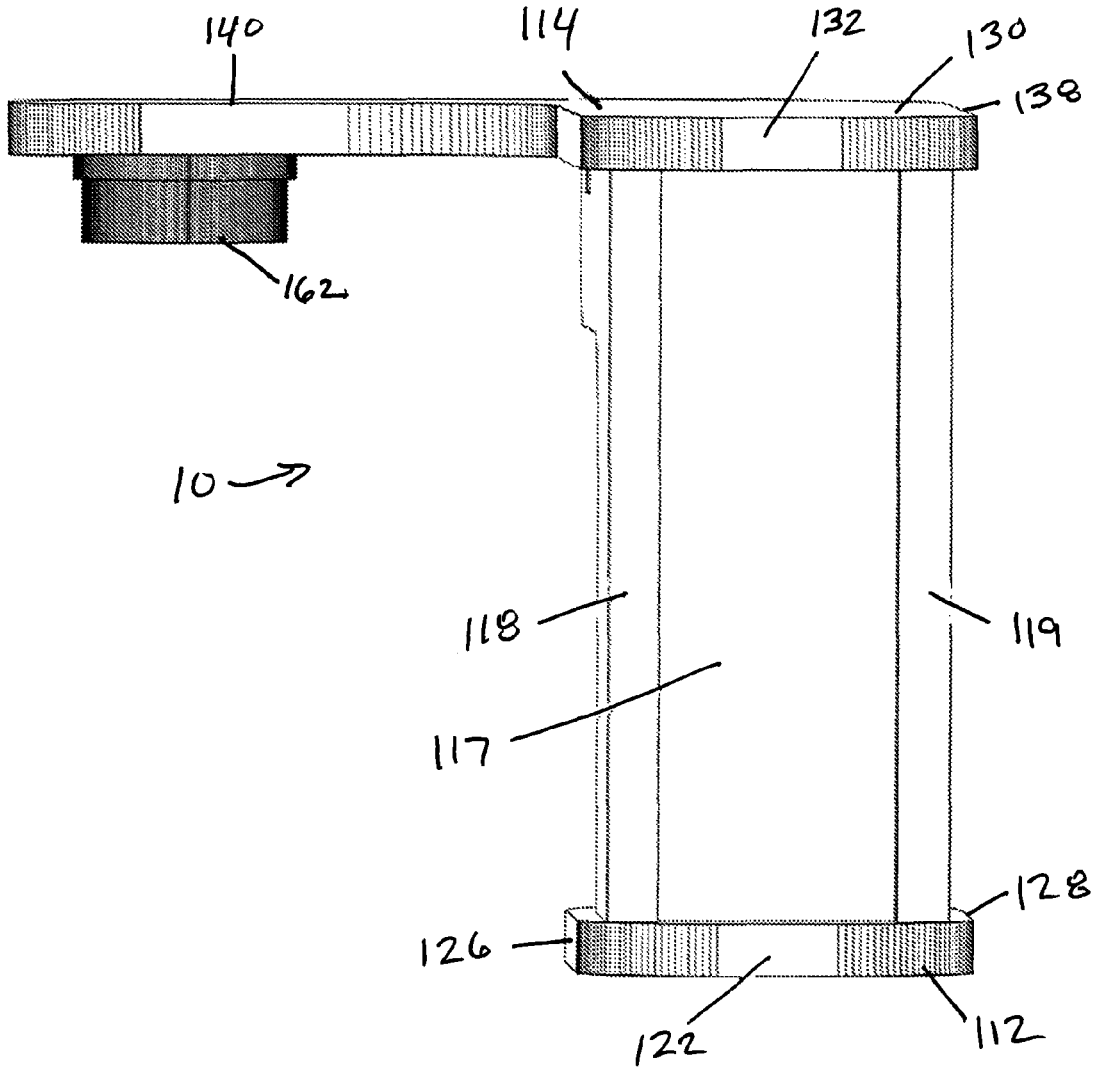
FIG. 5 is a longitudinal side view of the representative embodiment of the directional lighting apparatus for a sewing machine of FIG. 1.
Figure 6A:
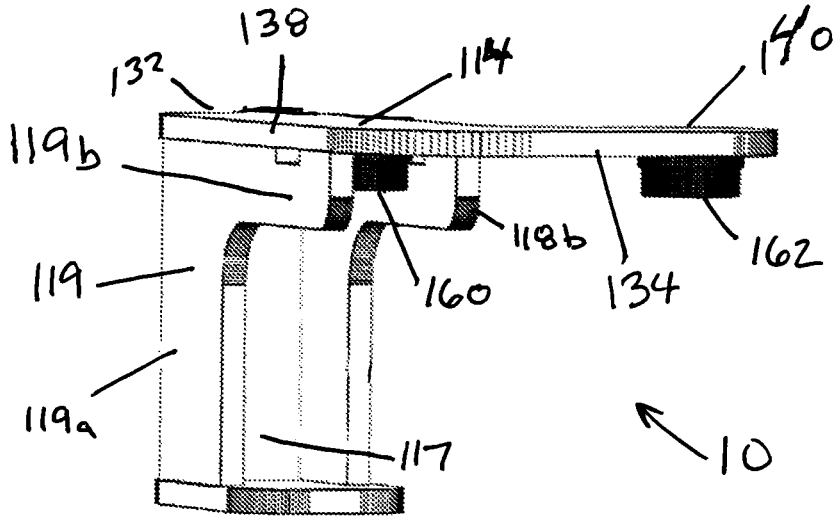
FIG. 6A is yet a different perspective view of the representative embodiment of the directional lighting apparatus for a sewing machine of FIG. 1.
Figure 6B:
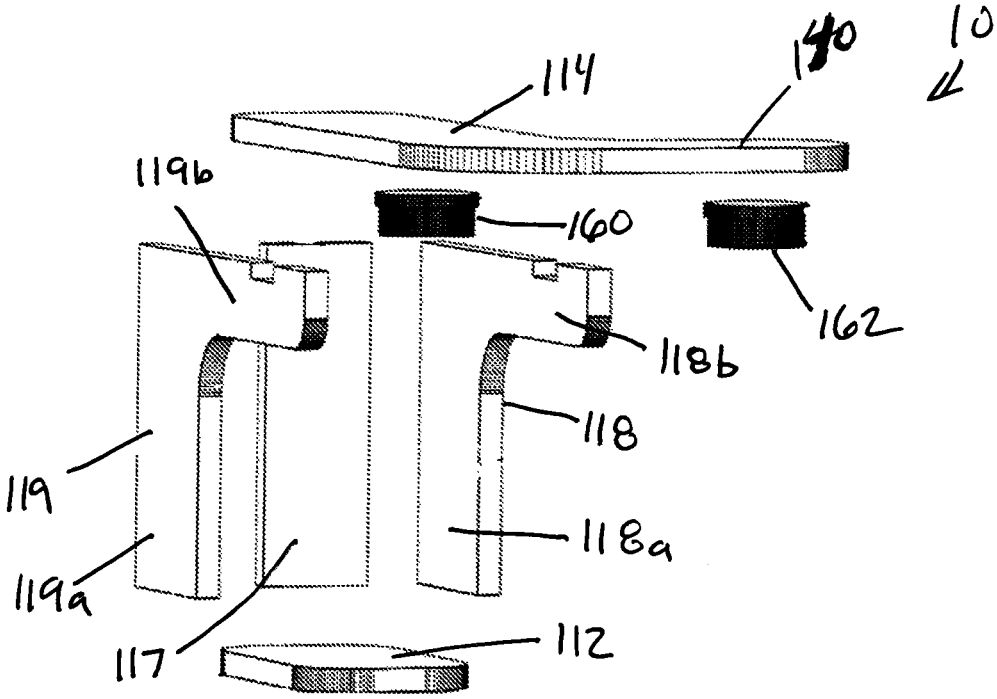
FIG. 6B is an exploded view of the representative embodiment of the directional lighting apparatus for a sewing machine of FIG. 6A.
Figure 7A:
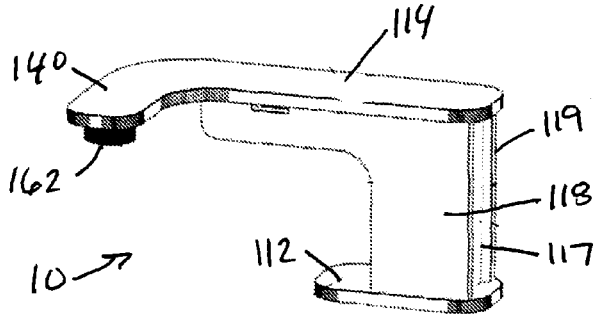
FIG. 7A is yet a different perspective view of the representative embodiment of the directional lighting apparatus for a sewing machine of FIG. 1.
Figure 7B:
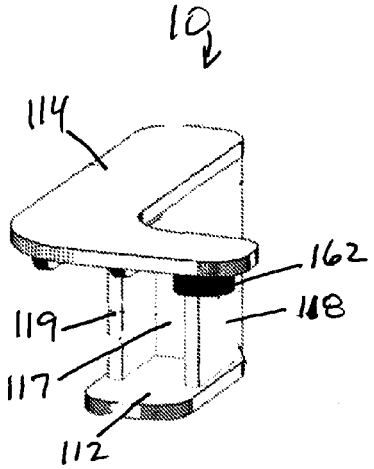
FIG. 7B is yet a different perspective view of the representative embodiment of the directional lighting apparatus for a sewing machine of FIG. 1.
Figure 7C:
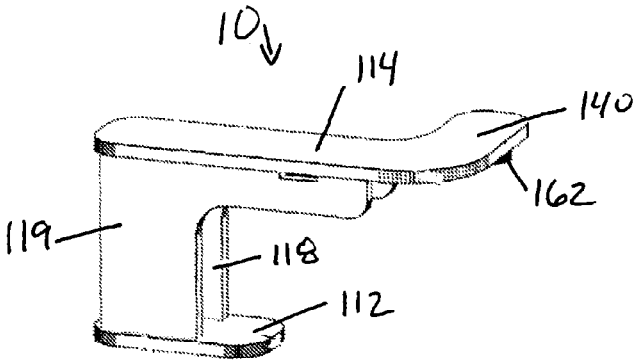
FIG. 7C is yet a different perspective view of the representative embodiment of the directional lighting apparatus for a sewing machine of FIG. 1.
Figure 7D:
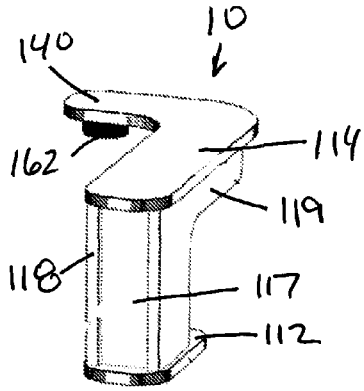
FIG. 7D is yet a different perspective view of the representative embodiment of the directional lighting apparatus for a sewing machine of FIG. 1.
Figure 8A:
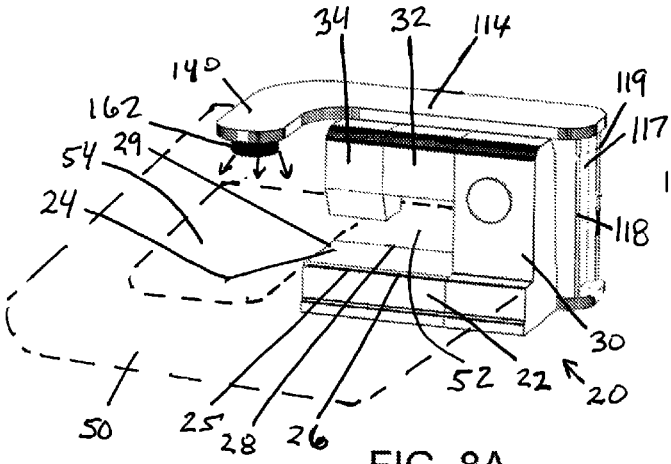
FIG. 8A is a perspective view of the representative embodiment of the directional lighting apparatus for a sewing machine of FIG. 1 positioned aside a representative sewing machine.
Figure 8B:
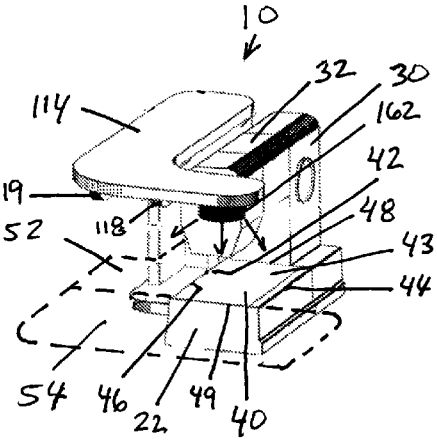
FIG. 8B is a different perspective view of the representative embodiment of the directional lighting apparatus for a sewing machine of FIG. 1 positioned aside a representative sewing machine.
Figure 8C:
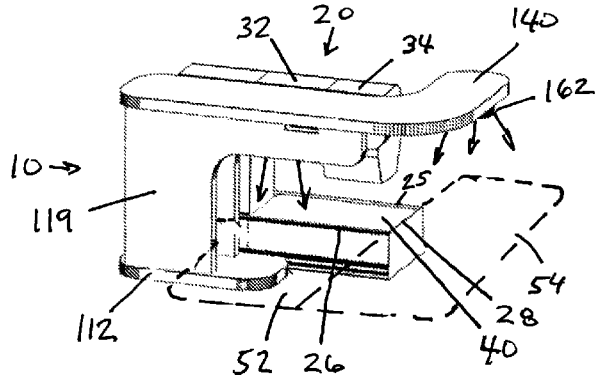
FIG. 8C is yet a different perspective view of the representative embodiment of the directional lighting apparatus for a sewing machine of FIG. 1 positioned aside a representative sewing machine.
Figure 8D:
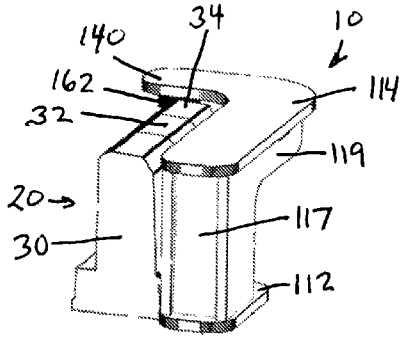
FIG. 8D is yet a different perspective view of the representative embodiment of the directional lighting apparatus for a sewing machine of FIG. 1 positioned aside a representative sewing machine.
Figure 9:
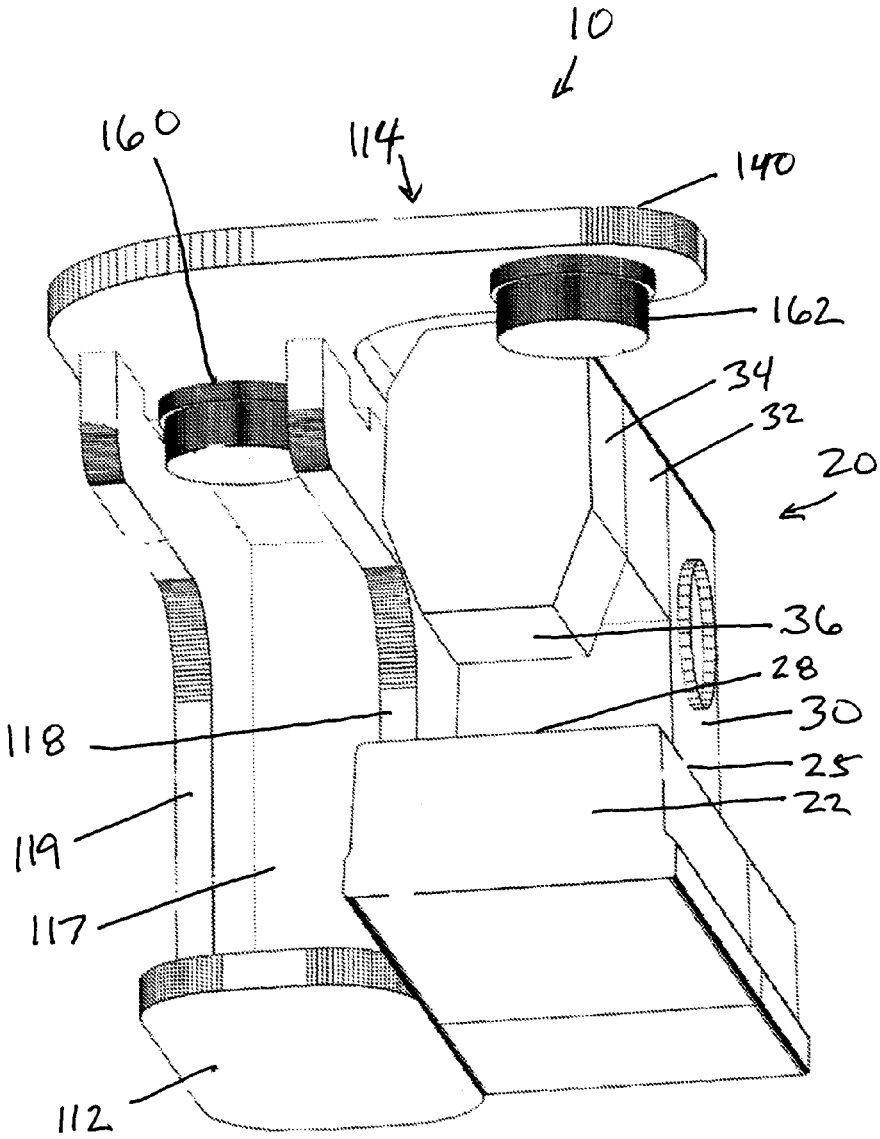
FIG. 9 is yet a different perspective view of the representative embodiment of the directional lighting apparatus for a sewing machine of FIG. 1 positioned aside a representative sewing machine.
Figure 10:
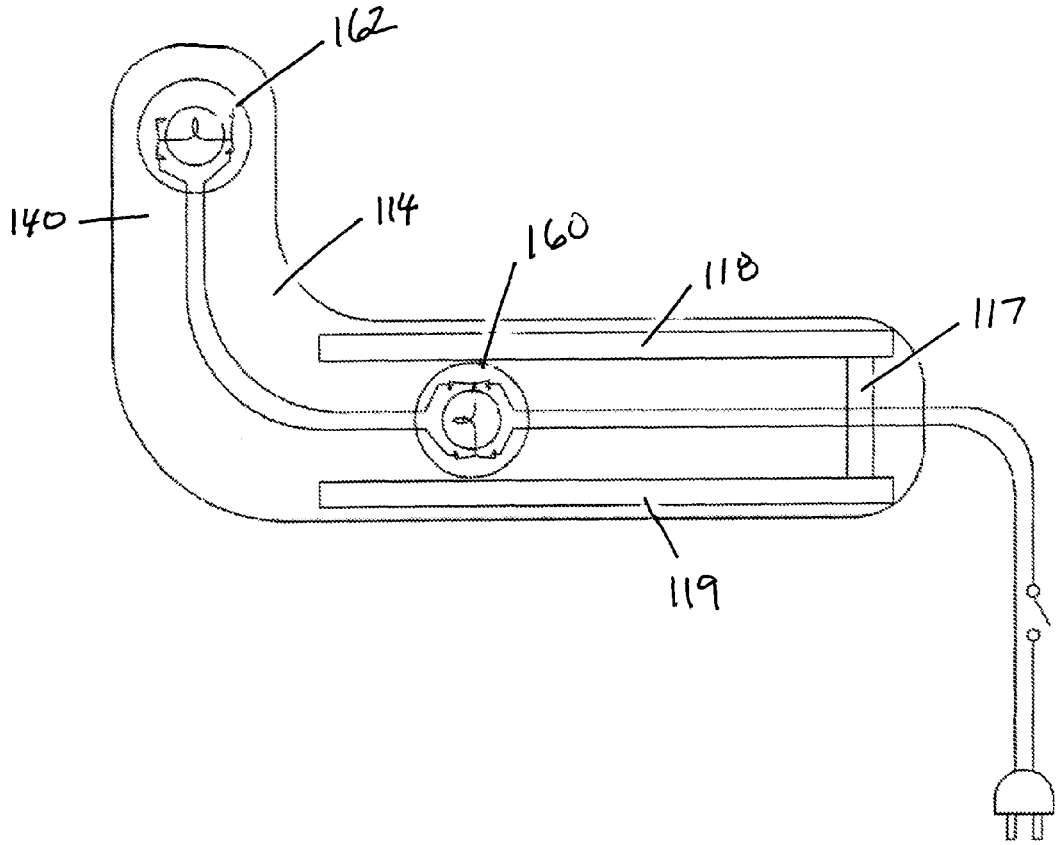
FIG. 10 is a view of the underside of the top of the representative embodiment of the directional lighting apparatus for a sewing machine of FIG. 1, schematically depicting wiring for the apparatus.

Referring to FIGS. 1-10, a first embodiment of a directional lighting apparatus 10 for use in combination with a sewing machine 20 is disclosed. As can be seen in FIGS. 8A-8D and 9, the sewing machine 20 comprises a bed 22 with a substantially flat upper surface 24 having an outer perimeter 25 defined by a first side 26, an opposing second side 28, an end 29 and the intersection between the upper surface 24 and a neck 30 that rises substantially vertically from the bed 22 adjacent the first side 26 of the upper surface 24. An elevated and elongated arm 32 extends substantially horizontally from the neck 30 and terminates at a head 34. The neck 30, the arm 32 and the head 34 are all positioned at least in part above the upper surface 24. As is well understood in the art, the sewing machine head 34 has an underside 36 (see FIG. 9) adapted to releasably secure a sewing needle having a tip operatively directed directly downward toward the upper surface 24.

A substantially horizontal central sewing work area 40 (FIGS. 8B, 8C), defined by the contours of the sewing machine 20, is oriented atop the upper surface 24 and generally bounded by the outer perimeter of the arm 32 and head 34 projected perpendicularly downward onto the upper surface 24. The central work area 40 thereby has a boundary 42 defining a generally rectangular shape with an elongate first side 44 and an opposing and generally parallel elongate second side 46. The first and second sides 42, 44 both extend perpendicularly away from a third side 48 formed at the intersection between the upper surface 24 and the neck 30, and terminate at a fourth side 49 opposite the third side 48. Hence, the central sewing work area 40 is generally positioned directly below the arm 32 and the head 34 and terminates at the neck 30. As can be seen, for the particular embodiment of the sewing machine 20 depicted in FIGS. 8A-8C and 9, the work area 40 substantially coincides with the contours of the upper surface 24. While the central work area 40 will not always coincide with the upper surface 24 on all sewing machine configurations, for most tabletop sewing machines, the central work area 40 extends from the inside of the neck 30 at one end to the distal end of the head 34 at the other end, and has a width generally equaling that of the arm 32 and head 34.

As is well understood by one of ordinary skill in the art, material and fabrics being sewn by the sewing machine 20 will regularly extend beyond the boundary 42 of the central sewing work area 40. Accordingly, adjacent and surrounding the central work area 40 is a generally horizontal support or peripheral work area generally depicted at 50. This peripheral work area 50 therefore substantially borders the central work area 40 and expands outwardly to varying distances from the central work area boundary 42 depending upon the specific sewing operation being conducted and the object or material being sewn in that operation. Of course as can be readily understood, lacking the vertical support provided by the upper surface 24 of the sewing machine base 22, fabric or material extending into the peripheral work area 50 may be somewhat less than horizontal as it drops over the edge of the upper surface 24 and drapes away from the central sewing work area 40.

Referring back to FIGS. 1-7, the lighting apparatus 10 has a body 110 with a relatively thin, flat, rounded rectangular base 112, a relatively thin flat top 114 positioned above and horizontally parallel to the base 112, and a vertical support 116 mounted atop the base 112 and bearing the top 114. The support 116 has a relatively thin, rectangular vertical spine 117 that spans perpendicularly between a relatively thin inner wing 118 and a relatively thin parallel outer wing 119. The spine 117 and wings 118, 119 span between the top of the base 112 and the underside of the top 114. Both of the wings 118 and 119 share the same vertical profile, having matching generally rectangular portions 118*a* and 119*a*, and matching arms 118*b* and 119*b*. The arms 118*b* and 119*b* are approximately one third the height of the rectangular portions 118*a* and 119*a* and extend along and attach to the underside of the top 114, where they form a three-walled downwardly directed channel 120 (see FIGS. 2A and 3).

From a plan perspective, the base 112 has a proximal end 122 and an opposing distal end 124 with parallel sides 126 and 128 extending there between. Similarly, from a plan perspective, the top 114 an elongate portion 130 having a proximal end 132 and an opposing distal end 134 with parallel sides 136 and 138 extending there between. As can be seen, the top 114 is "L" shaped such that a leg 140 extends perpendicularly from its distal end 134. Although the base 112 is shorter in length than the top 114, both are of approximately the same width, the distal end 132 is positioned directly above the distal end 122, and the sides 132, 134 are directly above and parallel to the sides 122, 124, respectively.

A first light source 160, by way of example in this embodiment a cylindrically encased directional LED light, is secured to the underside of the top 114 in the channel 120 approximately half-way across and midway along the length of the elongate portion 130. The light source 160 is pointed downward, and in conjunction with the shading limitations imposed by the sides of the wings 118*b* and 119*b*, the light from the light source 160 projects downward below the elongate portion 130.

A second light source 162, by way of example in this embodiment a cylindrically encased directional LED light, is secured to the underside of the top 114 approximately half-way across and near the far end of the leg 140. Although not constrained by sidewalls, such as the neck wings 118*b* and 119*b* surrounding the light source 160, the light source 162 is nonetheless pointed downward and therefore when activated projects light downward below the leg 140.

As depicted in FIGS. 8A-8D and 9, the lighting apparatus 10 is configured for placement in proximity to the sewing machine 20 with the top 114 at least in part adjacent the sewing machine arm 32. In particular, the apparatus body 110 is configured to abut and wrap around one side of the neck 30 and arm 32 of the sewing machine 20, and the two adjoining sides of the head 34. In this way, the lighting apparatus 10 complements the sewing machine 20.

As can be appreciated, when the lighting apparatus 10 is positioned adjacent a sewing machine, such as the sewing machine 20 as depicted in FIGS. 8A-8D and 9, the light sources 160 and 162 are adapted to project light upon areas adjacent the central work area 40. In particular, when activated the first light source 160 projects light onto a first portion of the peripheral sewing work area 50, generally depicted at 52, that is peripheral and adjacent to the central work area 40 along the elongate second side 46. Similarly, when activated the second light source 162 projects light onto a second portion of the peripheral sewing work area 50, generally depicted at 54, that is peripheral and adjacent to the central work area 40 along the fourth side 49. The depictions of the first and second portions of the peripheral work area 50 at 52 and 54 are not intended to expressly delineate the precise outline of either the first or second portions. Rather, the exact areas of illumination provided by the light sources 160 and 162 will vary to some extent upon, e.g., the specific light bulb(s) or LED(s) used, their exact position and orientation under the top 114, and the positioning of the material in the peripheral work area 50, but will always be primarily directed to the general areas depicted as 52 and 54. Moreover, the illumination provided by the first and second light sources 160 and 162 may somewhat overlap each other, and may project to some extent into the central work area 40. Nonetheless, one of ordinary skill in the art will recognize that the primary illumination provided by the both light sources 160 and 162 will be in the peripheral work area 50. Further, although depicted in FIG. 10 as operating in a single series circuit, one of ordinary skill in the art will recognize that the lighting apparatus 10 may readily be configured with different wiring and/or switches such that the light sources 160 and 162 may be electively operated individually or simultaneously.

While we have described in the detailed description two configurations that may be encompassed within the disclosed embodiments of this invention, numerous other alternative configurations, that would now be apparent to one of ordinary skill in the art, may be designed and constructed within the bounds of our invention as set forth in the claims. Moreover, the above-described lighting apparatus 10 and the sewing machined 20 with which the apparatus 10 may be associated can both be arranged in a number of other and related varieties of configurations without expanding beyond the scope of our invention as set forth in the claims.

For example, the lighting apparatus 10 may be configured to fit a variety of models and configurations of the sewing machine 20, or the apparatus 10 may alternately be configured specifically to mate with or otherwise complement a specific configuration, model or set of models of sewing machines 20. Accordingly, the apparatus 10 may be configured without the leg 140 for the top 114, or may include more than one such leg 140. Further, the lighting apparatus 10 may be configured to attach to the sewing machine 20 using any number of devices and components well understood in the art.

In addition, the light sources 160 and 162 need not be positioned only as shown in FIGS. 1-10. Rather, the light sources 160 and 162 can be positioned in variety of orientations on the underside of the top 114, including for example, linearly along the elongate portion 130 or on different positions on the elongate portion 130 and/or the leg 140. Further, the light sources 160 and 162 may be configured to be directionally adjustable, or may be configured to direct light to more than one area. The lighting apparatus 10 may have more than the two light sources 160, 162. The light sources, including 160 and 162, may be, for example, an incandescent bulb, a gas-discharge bulb, or an LED bulb. Also, the light sources 160, 162 may all be the same type of light source or a mixture of different types of light sources.

Light shades or "blinders" such as wings 118*b* and 119*b* may also be positioned about the light source 162 and any other light sources that may be added to the apparatus 10. These shades or "blinders", including wings 118*b* and 119*b*, may be of differing sizes and shapes in order to control the direction of the light from the various light sources, including 160 and 162, so as to provide illumination to the peripheral sewing work area 50.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

The invention claimed is:

1. A directional lighting apparatus for a sewing machine, the sewing machine comprising a bed with a substantially flat upper surface having an outer perimeter, a first end and an opposing second end; a neck rising substantially vertically from the bed adjacent the first end of the upper surface, an elevated and elongated arm extending substantially horizontally from the neck and terminating at a head, the neck and head positioned at least in part above the upper surface; the head having an underside adapted to releasably secure a sewing needle having a tip; the sewing machine having a central sewing work area and a peripheral sewing work area; the central sewing work area being substantially horizontal atop the bed and having an outer boundary defined substantially by the perimeter of the upper surface of the bed of the sewing machine such that the boundary has a first side and an opposing second side, the first and second sides extending generally perpendicular away from the sewing machine neck; the peripheral sewing work area being generally horizontal, and bordering and extending away from the boundary of the central sewing work area; the lighting apparatus comprising:

a. a body having a base, an elongate top positioned above the base, and one or more supports there between connecting the top and the base, the body configured for placement in proximity to the sewing machine with the top at least in part adjacent the sewing machine arm;

b. a first light source positioned on the top and configured to primarily illuminate a first portion of the peripheral sewing work area adjacent the central sewing work area when the top of the lighting apparatus is positioned adjacent the sewing machine; and c. a second light source positioned on the top and configured to primarily illuminate a second portion of the peripheral sewing work area adjacent the central sewing work area when the top of the lighting apparatus is positioned adjacent the sewing machine, the first and second portions of the peripheral sewing work area having different positions.

2. The lighting apparatus of claim 1, wherein the first light sources is configured to illuminate a portion of the peripheral sewing work area adjacent a portion of the first side of the central sewing work area boundary.

3. The lighting apparatus of claim 1, wherein the first light source is configured to illuminate a portion of the peripheral sewing work area adjacent a portion of the boundary of the central sewing work area opposite the sewing machine neck.

4. The lighting apparatus of claim 1, wherein the first light source is offset in two axes from the second light source.

5. The lighting apparatus of claim 1, wherein the top has a first section and a second section, the first and second sections defining an angle to allow the top to wrap at least in part around the sewing machine arm and head.

6. The lighting apparatus of claim 5, wherein the first light source is positioned on the first section of the top and the second light source is positioned on the second section of the top.

7. The lighting apparatus of claim 6, wherein the first light source is configured to illuminate a portion of the peripheral sewing work area adjacent a portion of the first side of the central sewing work area boundary, and second light source is configured to illuminate a portion of the peripheral sewing work area adjacent a portion of the boundary of the central sewing work area opposite the sewing machine neck.

8. The lighting apparatus of claim 5, wherein the angle is approximately 90 degrees.

9. The lighting apparatus of claim 1, wherein the first light source is adapted to be selectively directed to one of a plurality of portions of the peripheral sewing work area.

10. The lighting apparatus of claim 1, wherein the top has an underside and the first light source is positioned on the underside of the top.

11. The lighting apparatus of claim 1, wherein the body has a contour and the sewing machine has a contour, and the body contour is configured to complement the sewing machine contour when the lighting apparatus is positioned adjacent the sewing machine.

12. The lighting apparatus of claim 1, wherein the body has a contour and the body contour is configured to complement the contours of a particular model of sewing machine when the lighting apparatus is positioned adjacent the particular model of sewing machine.

13. The lighting apparatus of claim 1, further comprising a light shield positioned in proximity to the first light source and configured to screen at least some of the illumination from the first light source from illuminating the central sewing work area.

14. The lighting apparatus of claim 13, wherein the light shield is attached to the top.

15. The lighting apparatus of claim 1, wherein the first light is selected from the group consisting of an incandescent bulb, a gas-discharge bulb, or an LED bulb.

16. In combination with a sewing machine comprising a bed with a substantially flat upper surface having an outer perimeter, a first end and an opposing second end; a neck rising substantially vertically from the bed adjacent the first end of the upper surface, an elevated and elongated arm extending substantially horizontally from the neck and terminating at a head, the neck and head positioned at least in part above the upper surface; the head having an underside adapted to releasably secure a sewing needle having a tip; the sewing machine having a central sewing work area and a peripheral sewing work area; the central sewing work area being substantially horizontal atop the bed and having an outer boundary defined substantially by the perimeter of the upper surface of the bed of the sewing machine such that the boundary has a first side and an opposing second side, the first and second sides extending generally perpendicular away from the sewing machine neck; the peripheral sewing work area being generally horizontal, and bordering and extending away from the boundary of the central sewing work area; a lighting apparatus comprising:

a. body having a base, an elongate top positioned above the base, and one or more supports there between connecting the top and the base, the body configured for placement in proximity to the sewing machine with the top at least in part adjacent the sewing machine arm;

b. a first light source positioned on the top and configured to primarily illuminate a first portion of the peripheral sewing work area adjacent the central sewing work area when the top of the lighting apparatus is positioned adjacent the sewing machine; and c. a second light source positioned on the top and configured to primarily illuminate a second portion of the peripheral sewing work area adjacent the central sewing work area when the top of the lighting apparatus is positioned adjacent the sewing machine, the first and second portions of the peripheral sewing work area having different positions.

* * * * *